US011352687B2

(12) United States Patent
Thomas et al.

(10) Patent No.: US 11,352,687 B2
(45) Date of Patent: Jun. 7, 2022

(54) TITANIUM ALLOYS HAVING IMPROVED CORROSION RESISTANCE, STRENGTH, DUCTILITY, AND TOUGHNESS

(71) Applicant: Titanium Metals Corporation, Henderson, NV (US)

(72) Inventors: Roger Owen Thomas, Swansea South Wales (GB); James S. Grauman, Henderson, NV (US); Paul Garratt, Swansea South Wales (GB); James G. Miller, Henderson, NV (US)

(73) Assignee: Titanium Metals Corporation, Henderson, NV (US)

( * ) Notice: Subject to any disclaimer, the term of this patent is extended or adjusted under 35 U.S.C. 154(b) by 121 days.

(21) Appl. No.: 16/707,671

(22) Filed: Dec. 9, 2019

(65) Prior Publication Data

US 2020/0181749 A1 Jun. 11, 2020

Related U.S. Application Data

(60) Provisional application No. 62/777,213, filed on Dec. 9, 2018.

(51) Int. Cl.

| | |
|---|---|
| ***C22F 1/18*** | (2006.01) |
| ***C22C 1/02*** | (2006.01) |
| ***C22C 14/00*** | (2006.01) |

(52) U.S. Cl.

CPC ..... *C22F 1/183* (2013.01); *C22C 1/02* (2013.01); *C22C 14/00* (2013.01)

(58) Field of Classification Search

None

See application file for complete search history.

(56) References Cited

U.S. PATENT DOCUMENTS

| | | | |
|---|---|---|---|
| 6,607,846 | B1 | 8/2003 | Grauman et al. |
| 2004/0058190 | A1 | 3/2004 | Graumen et al. |

FOREIGN PATENT DOCUMENTS

| | | |
|---|---|---|
| CN | 102834537 | 12/2012 |
| CN | 108467971 | 8/2018 |

(Continued)

OTHER PUBLICATIONS

English language machine translation of RU 2256713 to Kablov et al. Generated Sep. 28, 2021. (Year: 2021).*

(Continued)

*Primary Examiner* — Brian D Walck

(74) *Attorney, Agent, or Firm* — Burris Law, PLLC

(57) ABSTRACT

Titanium alloys with an improved and unexpected combination of corrosion resistance, strength, ductility and toughness are provided. The titanium alloys contain molybdenum, nickel, zirconium, iron, and oxygen as alloying agents. Also the titanium alloys may be subjected to thermal treatments. The titanium alloys can include molybdenum between 3.0 to 4.5 wt. %, nickel between 0.1 to 1.0 wt. %, zirconium between 0.1 to 1.5 wt. %, iron between 0.05 to 0.3 wt. %, oxygen between 0.05 to 0.25 wt. %, and a balance of titanium and unavoidable impurities. The titanium alloys can have a yield strength between 550 to 750 MPa, a tensile strength between 700 to 900 MPa, an elongation to failure between 25 to 35%, a reduction in area between 55 to 70%, and a corrosion rate between 0.5 to 2.5 mils per year when exposed to 1 wt. % boiling hydrochloric acid per the ASTM G-31 test method.

20 Claims, 11 Drawing Sheets

(56) References Cited

FOREIGN PATENT DOCUMENTS

| | | | |
|---|---|---|---|
| DE | 19533743 | | 3/1997 |
| DE | 102014014683 | | 4/2016 |
| JP | 2000144287 | | 5/2000 |
| RU | 2256713 | * | 7/2005 |
| RU | 2391426 | * | 6/2010 |

OTHER PUBLICATIONS

English language machine translation of RU 2391426 to Fedorov et al. Generated Sep. 28, 2021. (Year: 2021).*
Tarzimoghadam, Z. et al., Microstructure design and mechanical properties in a near-a Ti—4Mo alloy, Acta Materialia, 2015, vol. 97, pp. 291-304, Elsevier Ltd.
Timet, GeoTi™ Titanium Geothermal Casing product page.
Schuiz, R.W., Developments in Titanium Alloy Environmental Behavior, Titanium '95: Science and Technology, 1995, pp. 1860-1870.
Wu, Y. et al., Effect of Heat Treatment on the Corrosion Behavior of Ti—0.3Mo—0.8Ni, Sixth World Conference on Titanium, 1988, pp. 1717-1721, France.
Zhang, W. et al., Elastic modulus of phases in Ti—Mo alloys, Materials Characterization, 2015, pp. 302-307, vol. 106, Elsevier Inc.
Schutz, R.W. et al., Fundamental Corrosion Characterization of High-Strength Titanium Alloys, Industrial Applications of Titanium and Zirconium, edited by C.S. Young and J.C. Durham, American Society for Testing and Materials, 1986, vol. 4, pp. 130-143, Philadelphia.
Dobromyslov, A., General Regularities of Formation of the w-phase in Binary Titanium-base Alloys with Metals of IV-VIII,I Groups of the Periodic Table, Proceedings of the 12th World Conference on Titanium, pp. 410-414.
Kalabukhova, S.V., et.al., Investigation of the Mechanical Properties of Ti—Mo—Ni Alloys, English translation of Izvestiya Akademii nauk SSSR Metally, 1970, pp. 131-133, vol. 3, Scientific Information Consultants Limited, London.
Kalabukhova, S.V. et al., Test Methods and Properties of Materials: Polythermal Ti-EMoNi (9:1) Section of the Ternary System Ti—Mo—Ni, pp. 109-112, translated from Prorshkovaya Metallurgiya, vol. 2(110), 1972, Consultants Bureau, a division of Plenum Publishing Corporation.
Timet, Quality Products and Services brochure, 1989, pp. 1-20.
Caplan, I.L., Strength and Toughness of Binary Ti—Ni and Ti—Mo Alloys, 1976, pp. 2173-2179, from 3rd World Conference on Ti, Moscow.
Stern, et al., The Influence of Noble Metal Alloy Additions on the Electrochemical and Corrosion Behavior of Titanium, submitted to the Journal of the Electrochemical Society, Apr. 1959.
Hall, J.A. et al., The Relationships of Structure and Corrosion Behavior of Ti—0.3Mo—0.8Ni (TiCode-12), pp. 2603-2610.
Covington, The Role of Multi-Valent Metal Ions in Suppressing Crevice Corrosion of Titanium, pp. 2395-2403, reprinted from Titanium Science and Technology, vol. 4, R.I. Jaffee and H.M. Burte, editors, Plenum Publishing Corporation, New York.
Bania, Paul J. et al, Development of a Near-Alpha Alloy with Excellent Energy Related Toughness, presented at the Eighth World Conference on Titanium, 1995, Birmingham, England.
Forney, C. E. et al., Ti-3A1-2.5V Seamless Tubing Engineering Guide, 1990, 3rd edition, pp. 5-8, Sandvik Special Metals Corporation, Washington.
Grauman, James S., Titanium-Properties and Applications for the Chemical Process Industries, Reprinted from Encyclopedia of Chemical Processing and Design, 1998, vol. 58, pp. 123-147, Marcel Dekker, Inc.
Boyer, et al., Materials Properties Handbook: Titanium Alloys, pp. 213-214, ASM International.
International Search Report for International Application PCT/US2019/065213, dated Feb. 18, 2020.
Office Action regarding Chinese Patent Application No. 201980091503.5, dated Mar. 3, 2022, and English translation thereof.

* cited by examiner

| | Ti | Fe | Ni | Zr | Mo | Total |
|---|---|---|---|---|---|---|
| Spectrum 1 | 96.59 | 0.00 | 0.36 | 0.62 | 2.43 | 100.00 |
| Spectrum 4 | 90.21 | 0.55 | 1.25 | 0.77 | 7.22 | 100.00 |
| Spectrum 5 | 96.14 | 0.18 | 0.28 | 0.75 | 2.64 | 100.00 |
| Spectrum 9 | 91.19 | 0.42 | 0.94 | 0.79 | 6.66 | 100.00 |

TITANIUM ALLOYS HAVING IMPROVED CORROSION RESISTANCE, STRENGTH, DUCTILITY, AND TOUGHNESS

CROSS-REFERENCE TO RELATED APPLICATIONS

This application claims priority to and the benefit of U.S. Provisional Application No. 62/777,213 filed on Dec. 9, 2018. The disclosure of the above application is incorporated herein by reference.

FIELD

The present disclosure relates to titanium alloys having an improved and unexpected combination of corrosion resistance, strength, ductility, and toughness.

BACKGROUND

The statements in this section merely provide background information related to the present disclosure and may not constitute prior art.

Titanium, being a reactive metal, relies on the formation and stability of a surface oxide film for corrosion resistance. Under stable conditions when the surface oxide film is present, titanium can demonstrate remarkable corrosion resistant behavior. The reverse is also true, however, in that when the surface oxide film is destabilized, extremely high corrosion rates may result. These conditions of oxide instability are generally at the two extremes of the pH scale, i.e., strongly acidic or alkaline solutions can create instability in the titanium oxide film.

Typically, when using titanium in an area of uncertain oxide film stability, alloying elements have been added to the titanium to enhance the oxide film stability, thus increasing its effective usefulness at the pH extremes. This practice has proven most effective for the acid end of the pH scale, where alloying can increase the stability of the oxide film by up to 2 pH units or more. Since pH is measured on a logarithmic scale, this translates to a potential increase in passivity of more than 100 fold in aggressive acid conditions, such as boiling hydrochloric acid (HCl). Several alloying elements have shown varying degrees of success in this regard, such as molybdenum, nickel, tantalum, niobium and the precious metals. Of this group, the platinum group metals (PGM) offer the most effective protection against corrosion. The platinum group metals are platinum, palladium, ruthenium, rhodium, iridium and osmium. However, the PGM are expensive.

The issues of corrosion resistant titanium alloys, among other issues related to the manufacture of corrosion resistant titanium alloys, are addressed in the present disclosure.

SUMMARY

A titanium alloy comprising a combination of alloying elements and processing principles which achieve improved mechanical properties and cost savings, as compared to ASTM Grade 12 titanium alloy (Ti-0.3Mo-0.8Ni), while maintaining equivalent resistance to severe corrosive applications is provided. The titanium alloy comprises molybdenum (Mo) between 3.0 to 4.5 wt. %, nickel (Ni) between 0.1 to 1.0 wt. %, zirconium (Zr) between 0.1 to 1.5 wt. %, iron (Fe) between 0.05 to 0.3 wt. %, oxygen (O) between 0.05 to 0.25 wt. %, and a balance of titanium (Ti) and unavoidable impurities is provided. The titanium alloy exhibits an improved range of yield strengths, as compared to titanium ASTM Grade 12 or other alpha/beta type titanium alloys.

In some variations of the present disclosure, the titanium alloy is alloyed with Mo within the range of 3.2 to 4.0 wt. %, Ni within the range of 0.3 to 0.5 wt. %, Zr within the range of 0.5 to 1.0 wt. %, Fe within the range of 0.1 to 0.25 wt. %, and O within the range of 0.12 to 0.18 wt. %.

The combination of increased Mo, Fe, O and Zr relative to Ti-0.3Mo-0.8Ni, and the thermomechanical processing of the titanium alloy below its beta transus to produce a fine microstructure comprising alpha and beta phase, enable the material to reach the required strength of 80 ksi (550 MPa) minimum 0.2% yield strength, while achieving superior ductility and toughness compared with Ti-0.3Mo-0.8Ni, due to a decrease in the Ni content.

The Zr addition, and the controlled additions of Fe and O increase the titanium alloy strength compared to previous compositions described in the prior art. Whereas Fe and O may be present to some extent in the raw materials for the alloy, in some variations of the present disclosure supplementary additions are required. For example, in some variations of the present disclosure, O is added as $TiO_2$ powder and Zr is added as Zr sponge or turnings. Also, there are many options for adding Fe to achieve the required composition.

The teachings of the present disclosure also include the preferred use of Cold Hearth Melting (CHM with Electron Beam or Plasma Arc Melting) for at least the first melt of an ingot, optionally followed by re-melting using the VAR method. The Cold Hearth Melting controls the addition of Mo as metallic Mo, Ti-50% Mo or Fe-65% Mo and prevents the occurrence of Mo inclusions in the ingot. The addition of Zr improves the corrosion resistance of the alloy, and allows the Ni content to be reduced and enable improved ingot surfaces in CHM ingots and thus, improved yields. This in turn enables the capability to use lower cost EBCHM Single Melt cast slabs to be produced for the manufacture of plates and strip, and EBCHM Single Melt cylindrical and hollow ingots to be produced for the production of pipe.

While the titanium alloys according to the teachings of the present disclosure show improved corrosion resistance in any microstructural condition, one or more heat treatments can be used to tailor the mechanical properties for particular applications. In some variations of the present disclosure, the titanium alloy has unexpectedly high toughness in the annealed condition as well as the ability to be heat treated to high strength while maintaining the excellent corrosion behavior and ductility. Heat treatment can increase the yield strength from about 550 to over 900 MPa. Most lean alpha/beta type alloys, such as ASTM Grades 9 and 12, are not considered to be heat treatable. Rather, these alloys are typically cold worked and stress relieved in order to improve upon their strength. Even for the more beta rich alpha/beta titanium alloys that can be heat treated, obtaining a range of yield strengths equal to or greater than 350 MPa is never observed, i.e., heat treatable alpha/beta alloys exhibit a range of strength (from the heat treatment) of around 175 MPa or less. This extended range of yield strengths has only been observed before in meta-stable beta titanium alloys containing about 10% or more of beta stabilizing alloying elements. However, in these meta-stable beta titanium alloys, the lower strength condition is not thermally stable and these alloys are normally only utilized in the high strength condition. If left in the lower strength condition, the alloys are susceptible to embrittlement due to phase transformations. In contrast, the titanium alloys according to the teachings of the present disclosure possess thermal phase stability in both the medium and high strength conditions, all while containing less than 5% of beta stabilizing alloying elements. This is an unexpected characteristic of the titanium alloy compositions disclosed herein and at least one benefit of this feature is to allow the titanium alloy to be utilized in a medium strength, extremely high toughness condition, or as a high strength titanium alloy with the capability to be cold processed and then given a final strengthening heat treatment. Other high strength titanium alloys, such as Ti-6Al-4V (ASTM Grade 5 titanium), do not possess the capability to be cold processed easily.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 graphically depicts a comparison of the corrosion resistance of titanium ASTM Grades 2, 7, and 12;

FIG. 2 graphically depicts a phase diagram of the binary Ni—Ti system;

Figure 14:
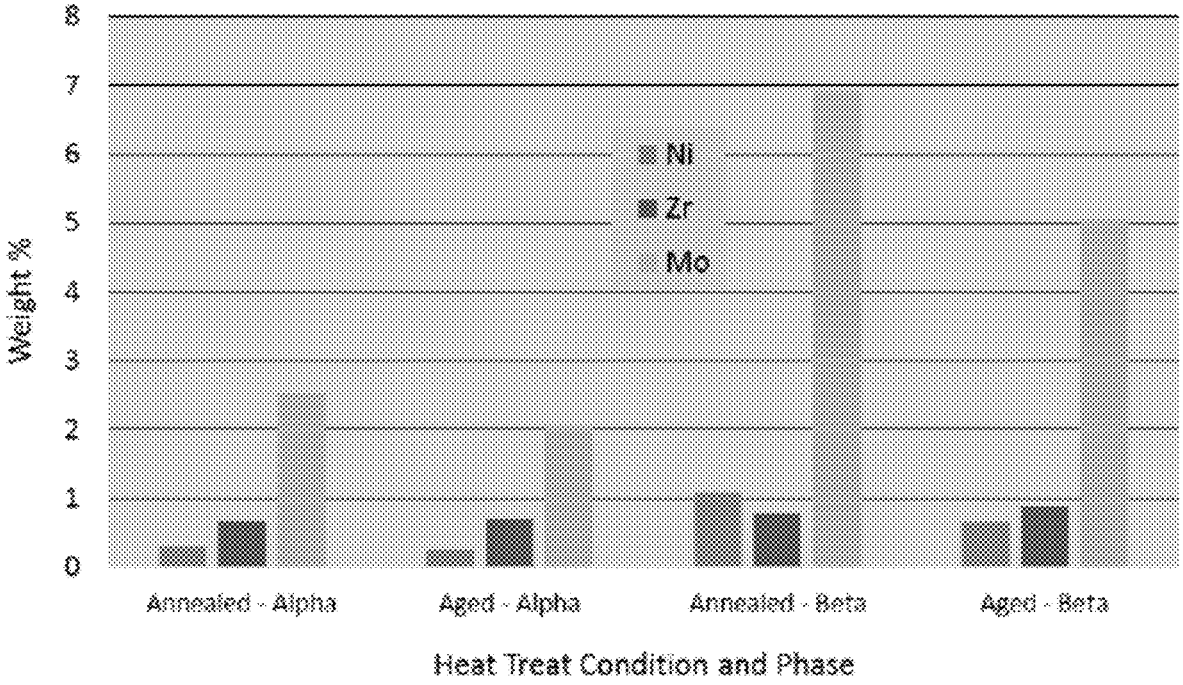
Figure 15:
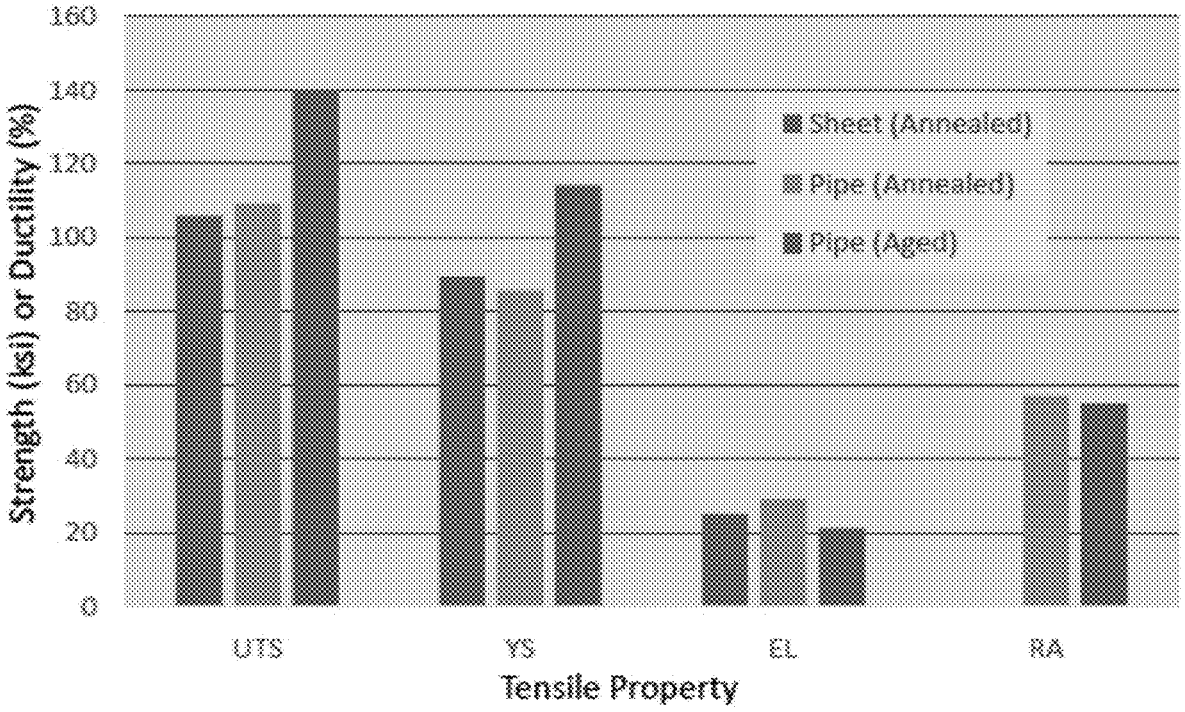
Figure 16:
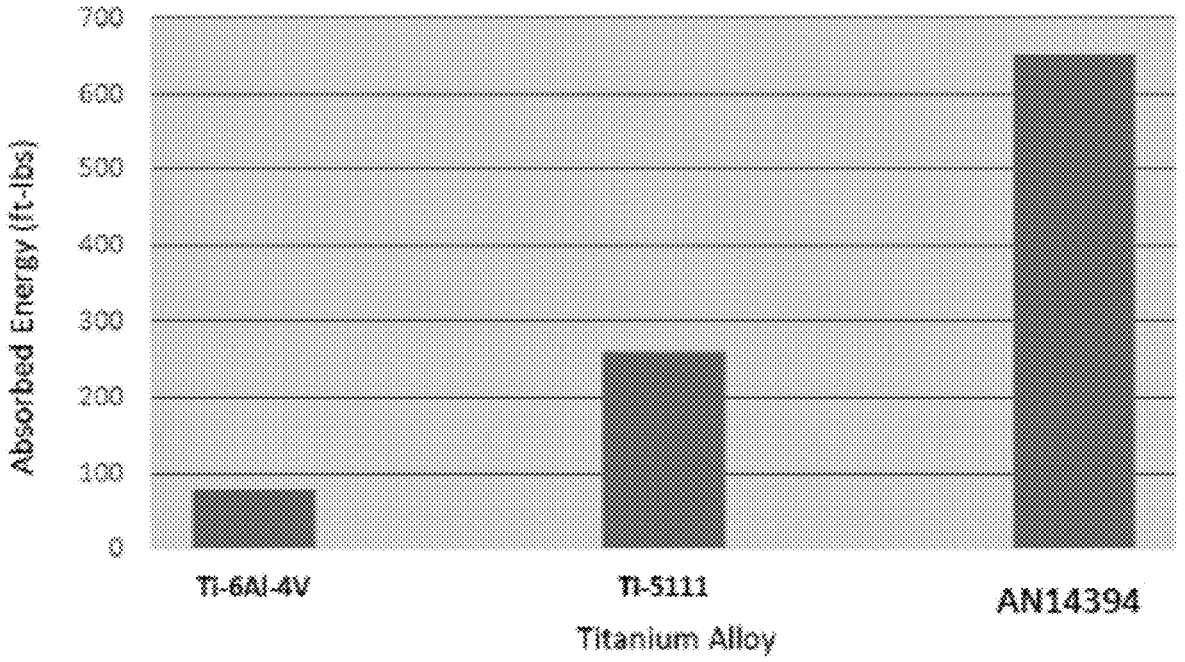
Figure 17:
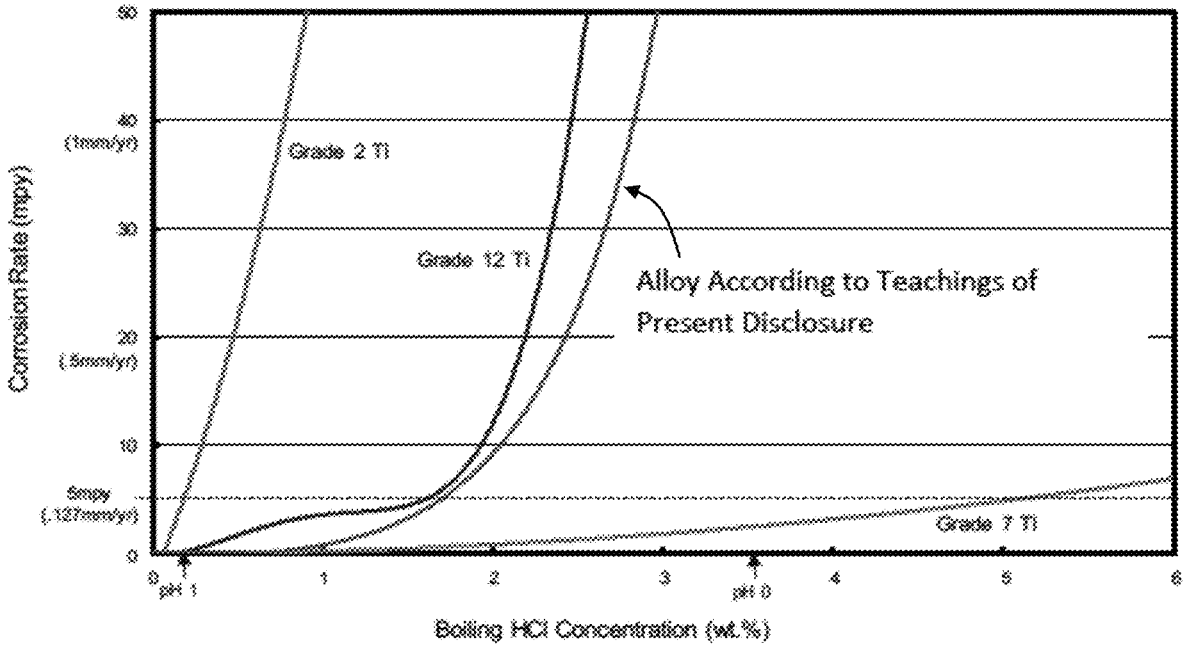
Figure 18:
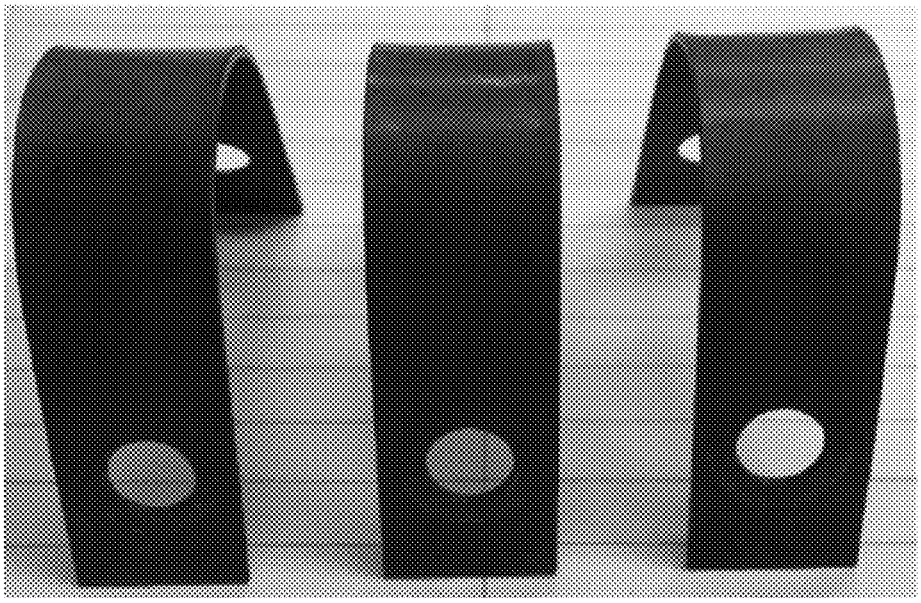
Figure 19:
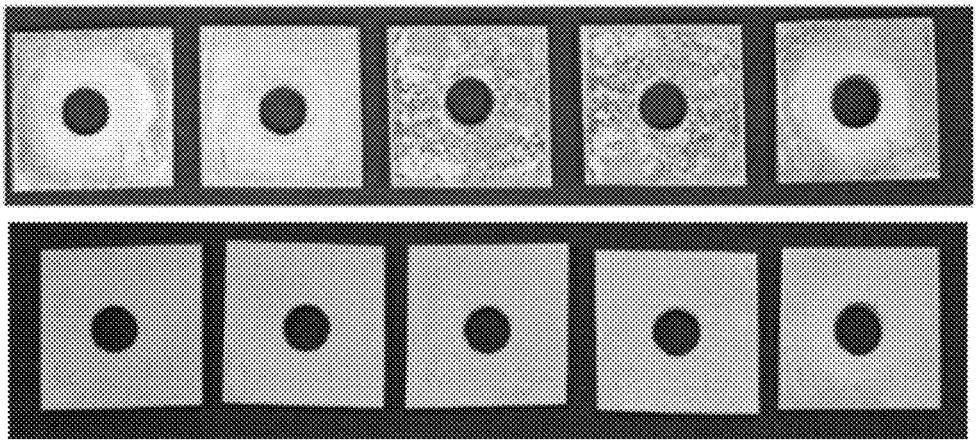

FIG. 14 graphically depicts elemental compositions of alpha and beta phases for a titanium alloy in the annealed and aged conditions formed according to the teachings of the present disclosure;

FIG. 15 is a bar chart of room temperature tensile test results of sheet and pipe formed from a titanium alloy in annealed and aged heat treat conditions formed according to the teachings of the present disclosure;

FIG. 16 is a bar chart of dynamic toughness values for a titanium alloy according to the teachings of the present disclosure compared to other titanium alloys;

FIG. 17 graphically depicts a comparison of the corrosion resistance of a titanium alloy according to the teachings of the present disclosure to titanium ASTM Grades 2, 7, and 12;

FIG. 18 is a photograph of post-exposure U-bend SCC samples of a titanium alloy according to the teachings of the present disclosure; and FIG. 19 is a photograph of post-exposure crevice corrosion samples of a titanium alloy according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As noted above, titanium alloys with the addition of platinum group metals (PGMs) offer the most effective protection against corrosion. For example, as little as 0.15% Pd or Pt alloying additions greatly enhances the stability of the oxide film on titanium (Ti), and thus the corrosion resistance, in hot reducing acid medium. Consequently, for many years the ASTM Grade 7 titanium (Ti-0.15Pd) has been the standard material chosen for use in severe corrosive conditions where unalloyed (low strength) titanium is subject to corrosion. More recently, ASTM Grade 16 (Ti-0.05Pd) has been used as a direct replacement for ASTM Grade 7 because it is more economical and provides a level of corrosion resistance close to that of ASTM Grade 7. Thus, it tends to be considered equivalent in less drastic corrosion applications.

It should be understood that the mechanism of protection afforded by platinum group metal additions to titanium is one of increased cathodic depolarization. The platinum group metals afford a much lower hydrogen overvoltage in acidic media, thereby increasing the kinetics of the cathodic portion of the electrochemical reaction. This increased kinetics translates to a change in the slope of the cathodic half reaction, leading to a more noble corrosion potential for the titanium. The active/passive anodic behavior of titanium allows for a small shift in corrosion potential (polarization) to effect a large change in the corrosion rate.

Alloying titanium with any of the PGM elements adds cost to the alloy. Each of the PGM elements are more costly than titanium, thus producing a more costly product in order to achieve the desired enhanced corrosion protection. For example, the cost for adding a small amount of palladium (0.15%) can literally double or triple the cost of the material (depending on the prevailing price of palladium and titanium). Accordingly, corrosion resistant titanium alloys without the presence of PGM elements are of interest.

Figure 1:
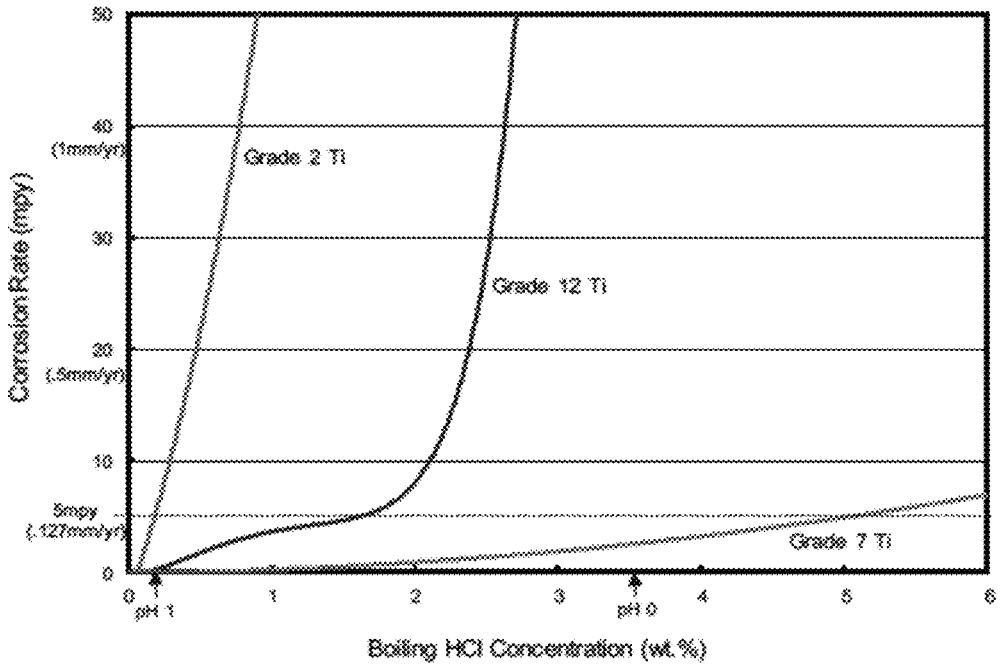

The titanium alloy ASTM Grade 12 (Ti-0.3Mo-0.8Ni) is one example of a titanium alloy without a PGM element addition that is superior to unalloyed titanium in several respects. The Ti-0.3Mo-0.8Ni alloy exhibits better resistance to crevice corrosion in hot brines (similar to that of Ti—Pd but at much lower cost) and is more resistant than unalloyed Ti (but not Ti—Pd) to corrosion in acids as shown in FIG. 1. The Ti-0.3Mo-0.8Ni alloy also offers greater strength than unalloyed grades for use in high temperature, high pressure applications. This permits the use of thinner wall sections in pressure vessels and piping, that translates into cost advantages. The Ti-0.3Mo-0.8Ni alloy is less expensive than the Ti—Pd grades but does not offer the same crevice corrosion resistance at pH<3. However, in near-neutral brines, crevice corrosion resistance of the Ti-0.3Mo-0.8Ni alloy is similar to Ti—Pd grades.

In the present disclosure, alloys with all of the desirable characteristics of the Ti-0.3Mo-0.8Ni alloy, such as formability; corrosion/SCC (stress corrosion cracking) resistance, and moderate cost, but with higher strength—for example, greater than or equal to 80 kilo-pounds per square inch (ksi) 0.2% yield strength (YS) (551.6 megapascals (MPa)), are provided. It should be understood that the titanium alloys according to the teachings of the present disclosure can be used in a variety of industries and markets such as but not limited to geothermal, hydrocarbon production, chemical production, marine markets, and the like. Also, the high strength (i.e., ≥550 MPa 0.2% YS) SCC resistant titanium alloys according to the teachings of the present disclosure allow for reduced gages, lighter weight components and lower costs since less titanium is required. In some variations of the present disclosure, the alloys are cold worked or formed in order to reduce manufacturing costs and to improve yields.

It should be understood that currently available titanium alloys capable of providing a combination of high strength and corrosion/SCC resistance are either highly alloyed beta titanium alloys, general purpose titanium alloys enhanced by addition of PGMs to achieve corrosion resistance, or Ti—Al—Mo—Zr alloys having attractive corrosion-wear characteristics. In each case it should be understood that there are factors in raw materials and manufacturing processes which result in commercial disadvantages. Also, oxygen (O) has been used as the main strengthening agent in commercially pure titanium Grades 1-4. However, when O levels exceed 0.20 wt. %, susceptibility for stress corrosion cracking becomes quite high. Thus, despite their desirable strength levels, which could lead to lighter weight components, Grades 3 and 4, with O levels above the 0.20% threshold, are typically avoided by end users when chloride media will be encountered. Also, additions of Al and Si which might be added to Ti-0.3Mo-0.8Ni to increase the alloy's strength also tend to have a deleterious effect on the corrosion resistance of the alloy.

Figure 2:
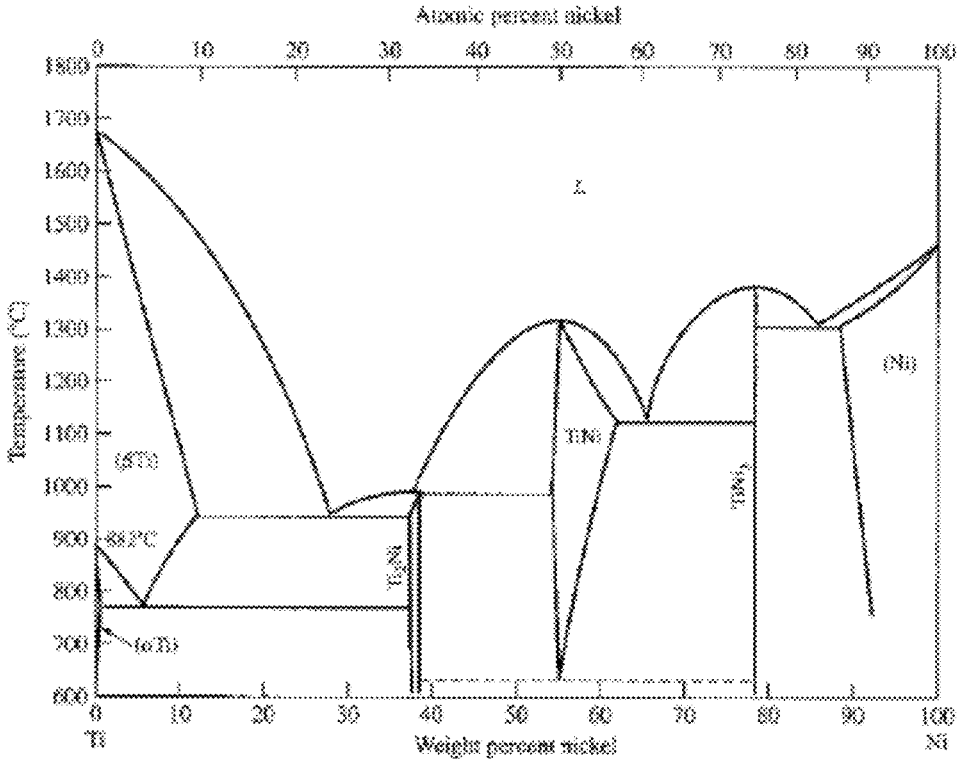
Figure 3:
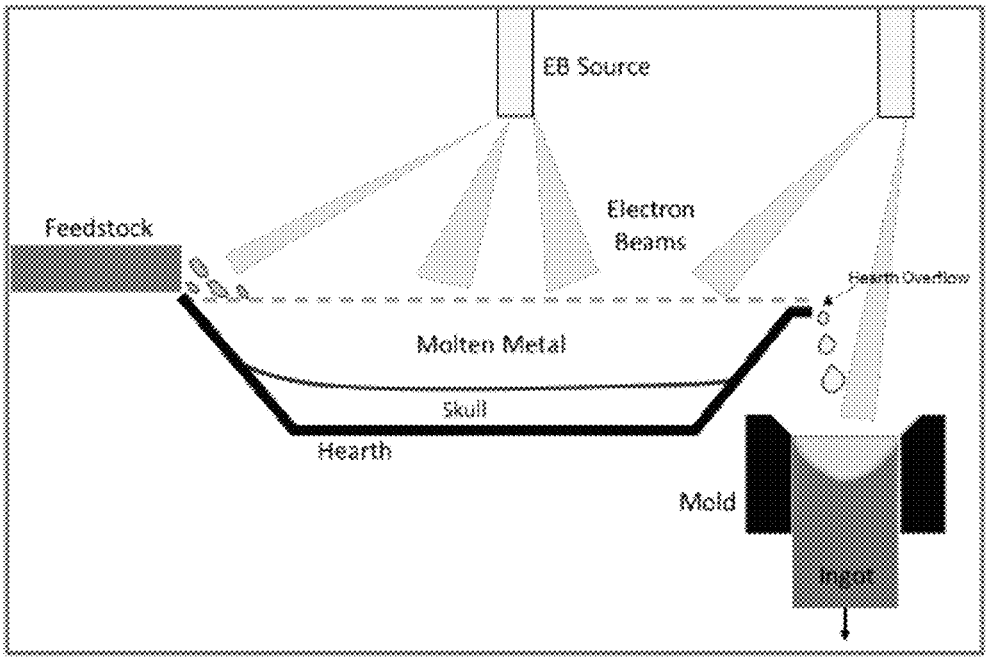
FIG. 3 depicts a Cold Hearth Melting (CHM) process.
Figure 4:
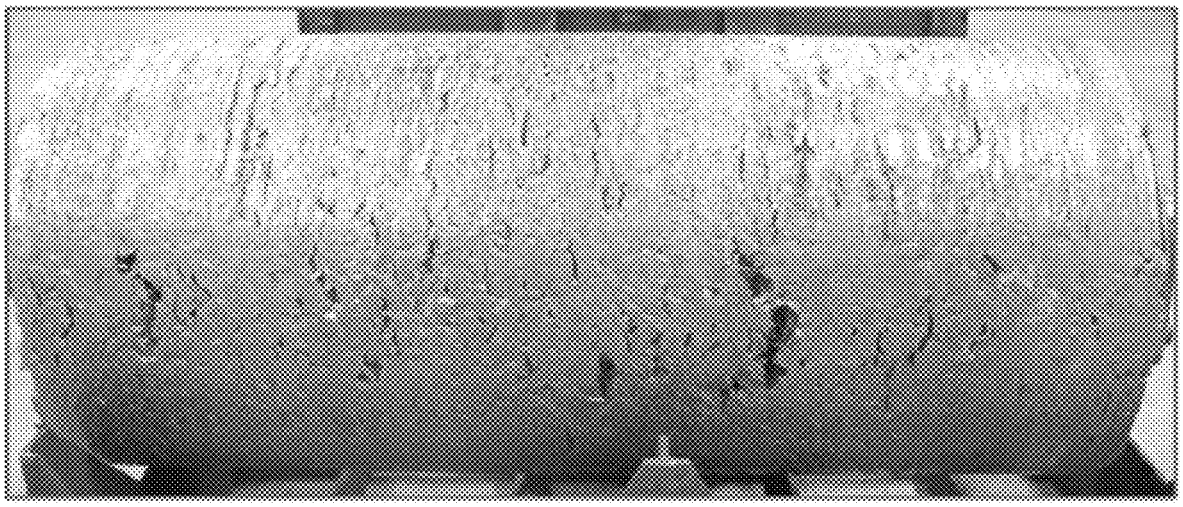
FIG. 4 is a photograph of Ti-0.3Mo-0.8Ni ingot produced by Electron Beam CHM (EBCHM) showing hot tears in the ingot surface.

Adding increasing amounts of Mo and Ni to titanium alloys results in increasing strength, but above an optimum amount results in the alloy being prone to degradation of ductility and toughness due to the formation of brittle precipitates. Nickel additions to titanium alloys are normally kept below 2 wt. % for this reason, limited by the occurrence of $Ti_2Ni$ precipitates, with the understanding that the shape memory alloys containing Ti 40-50 wt. % Ni are a different class of materials. The addition of Ni to titanium alloys presents additional manufacturing challenges, due to the occurrence of a comparatively low melting point eutectic of about 960° C. compared with a melting point of about 1660° C. melting point for pure titanium as shown in the Ti—Ni phase diagram in FIG. 2. Consequences of the occurrence of this eutectic include segregation of Ni-rich liquid during the solidification of the alloy, causing chemical inhomogeneity in ingots and products made from the ingots. Another consequence is that the presence of residual liquid during the production of ingots by cold hearth melting (CHM) methods, in which ingots are solidified by drawing them down through chilled ring molds, (e.g., see FIG. 3), can cause hot tearing of the ingot surface. FIG. 4 shows the results of hot tearing of an Ti-0.3Mo-0.8Ni alloy ingot formed by CHM.

Commercial titanium alloys containing Mo (up to 15 wt. %) and Al have benefits and drawbacks. Firstly, allowing the Mo to be added as an alloy element with Al which has a much lower melting point (about 660° C.) than the melting point of pure Mo (about 2620° C.), facilitates the production of homogeneous ingots. Secondly, the presence of Al in alloys tends to suppress the formation of brittle omega phase precipitates from non-equilibrium beta phase. However, the presence of Al in an alloy is deleterious for corrosion resistance.

Figure 5:
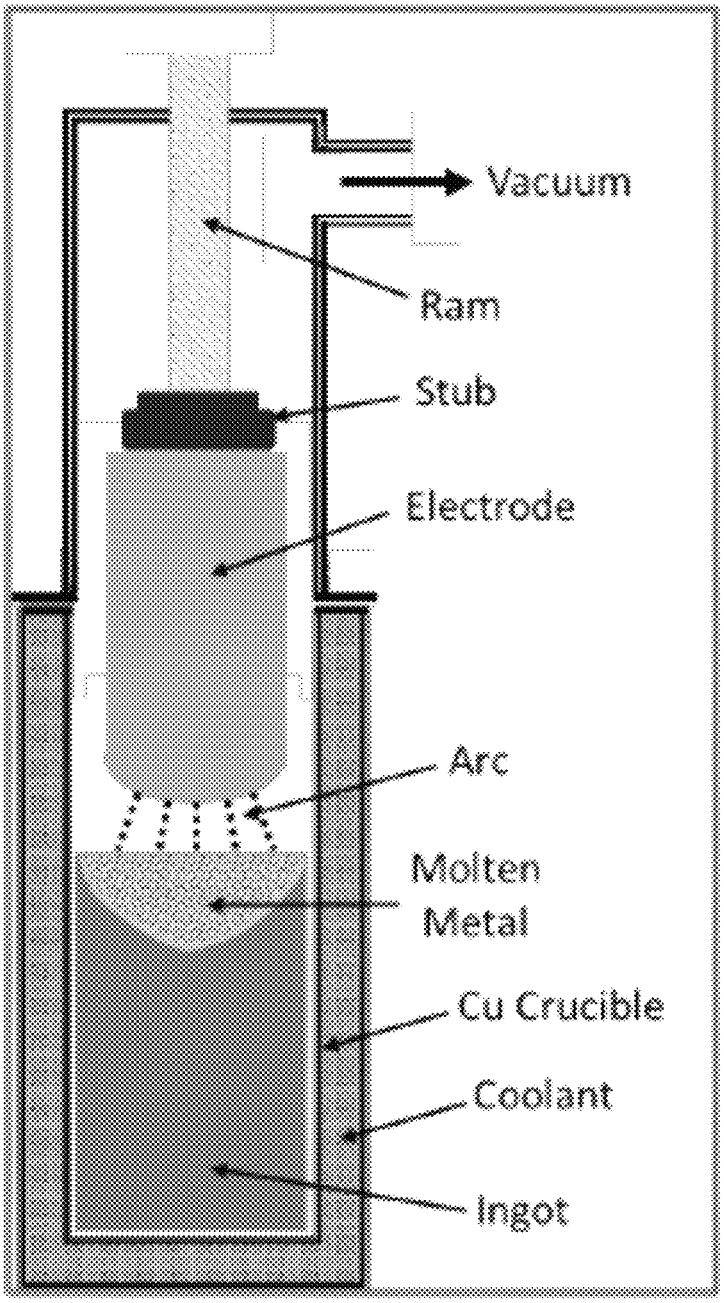
FIG. 5 depicts a VAR furnace.

The addition of Mo to titanium alloys which do not contain Al is a significant problem particularly in VAR melting furnaces (see FIG. 5), where unmelted metallic Mo particles with a density of about 10.4 grams per cubic centimeter ($g/cm^3$) contained in the electrode can drop through to the bottom of the pool of molten Ti alloy which has a density of about 4.5 $g/cm^3$, and thereby solidify as inclusions in the ingot. In the manufacture of Ti-0.3Mo-0.8Ni alloys, this can be overcome by using a Ni-50% Mo master alloy, which has a melting point of about 1360° C. For titanium alloys in which the Mo exceeds the Ni content, the use of a Ni-50% Mo master alloy is insufficient and the Mo must be added as metallic Mo as a Ti-50% Mo master alloy with a density of about 7.5 $g/cm^3$), or as ferro molybdenum which typically contains 60 to 75% Mo and has a density of about 9 $g/cm^3$). In order to control the risk of high density Mo-rich inclusions in the ingot, it is necessary to use a CHM process for at least the first melt. FIG. 3 illustrates the principle of using a Cold Hearth to trap high density inclusions entering the melting furnace in the raw materials stream via settling downward in the molten metal, and preventing them from reaching the ingot mold as disclosed in U.S. Pat. Nos. 4,750,542, 4,823,358, and 4,936,375, all of which are incorporated herein by reference. The CHM process may use Electron Beam (EBCHM) or Plasma Arc Melting (PAMCHM). An EBCHM has the advantage of being versatile in producing different ingot sections, so that it can be readily used to produce slabs for rolling to plate and strip, and also to produce hollow ingots as starting stock for the production of pipes, as disclosed in U.S. Pat. No. 8,074,704 and U.S. Patent Application 2010/0247946, both of which are incorporated herein by reference.

In experimental work leading to the titanium alloys according to the teachings of the present disclosure, mechanical property testing, and corrosion testing were performed on laboratory samples of titanium alloys of a wide range of compositions. Compositions tested and results reported are shown in Tables 1, 2, and 3 shown below. As shown in Tables 1-3, five (I-V) phases or groups of alloys were melted and tested and the results of Phase III are shown graphically in FIGS. 6 and 7. A representative microstructure of a key sample from this experimental work is shown in FIG. 8.

TABLE 1

| Alloy ID | Composition (wt.) | | | | | | | |
|---|---|---|---|---|---|---|---|---|
| | Ni | Mo | O | Fe | Si | Cr | Zr | C |
| Phase I | | | | | | | | |
| PA | 0.8 | 0.3 | 0.15 | 0.05 | 0.2 | | | |
| PB | 0.8 | 0.3 | 0.15 | 0.05 | 0.4 | | | |
| PC1 (Gr12) | 0.8 | 0.3 | 0.15 | 0.15 | | | | |
| PC2 | 0.8 | 0.3 | 0.15 | 0.05 | | | | |
| PD | 1 | 1 | 0.15 | 0.05 | | | | |
| PE | 1 | 1 | 0.15 | 0.05 | 0.3 | | | |
| PF | 0.8 | 1.7 | 0.15 | 0.05 | | 1.1 | | |
| PG | 0.8 | 0.3 | 0.15 | 0.05 | | | 1 | |
| PH | 0.8 | 0.3 | 0.15 | 0.05 | | | | 0.2 |
| PH+ | 0.8 | 0.3 | 0.15 | 0.05 | | | | 0.4 |
| Phase II | | | | | | | | |
| P2A | 0.8 | 1.55 | 0.15 | 0.5 | | | | |
| P2B | 0.8 | 1.55 | 0.15 | 0.5 | | | 1 | |
| P2C | 0.8 | 1.7 | 0.15 | 0.05 | 0.9 | | | |
| P2D | 0.8 | 1.7 | 0.15 | 0.4 | 0.3 | | | |
| P2E | 0.4 | 1.7 | 0.15 | 0.05 | | 1.1 | | |
| P2F | 0.4 | 3.5 | 0.15 | 0.05 | | | 1 | |
| P2G | 0.8 | 3.5 | 0.15 | 0.05 | | | | |
| P2H | 0.4 | 3.5 | 0.15 | 0.05 | | | | |
| P2I | 0 | 3.5 | 0.15 | 0.05 | 0.8 | | | |
| Phase III | | | | | | | | |
| P3A | 0.4 | 3.5 | 0.15 | 0.05 | | | 0.5 | |
| P3B | 0.4 | 3.5 | 0.15 | 0.05 | | | 0.1 | |
| P3C | 0.1 | 3.5 | 0.15 | 0.05 | | | 0.5 | |
| P3D | 0.1 | 3.5 | 0.15 | 0.05 | | | 0.1 | |
| P3E | 0.25 | 3.5 | 0.15 | 0.05 | | | 0.3 | |
| P3F | 0.1 | 3.5 | 0.15 | 0.05 | | | 1 | |
| P3A | 0.4 | 3.5 | 0.15 | 0.05 | | | 0.5 | |

| Alloy ID | Tensile Properties (MPa or %) | | | | Corrosion Rates (mpy) in Boiling HCl | | | |
|---|---|---|---|---|---|---|---|---|
| | UTS | YS | EL | RA | 1 wt % | 2 wt % | 3 wt % | 4 wt % |
| Phase I | | | | | | | | |
| PA | 575 | 398 | 30 | 38 | 0.7 | 6.4 | 565 | — |
| PB | 612 | 428 | 27 | 32 | 0.4 | 14.6 | 598 | — |
| PC1 (Gr12) | 553 | 362 | 25 | 31 | 0.7 | 12 | 651 | — |
| PC2 | 547 | 354 | 28 | 37 | 0.4 | 4.4 | 402 | — |
| PD | 678 | 506 | 22 | 27 | 0.6 | 4.2 | 20 | — |
| PE | 709 | 545 | 20 | 26 | 0.5 | 7.5 | 55 | — |
| PF | 764 | 632 | 29 | 49 | 0.2 | 2.5 | 250 | — |
| PG | 559 | 374 | 26 | 36 | 0.1 | 3.4 | 23 | — |
| PH | 671 | 500 | 25 | 29 | 0.9 | 102 | — | — |
| PH+ | 698 | 508 | 25 | 32 | 0.7 | 22.1 | 369 | — |
| Phase II | | | | | | | | |
| P2A | 703 | 530 | 26 | 38 | 0.9 | 22 | 526 | — |
| P2B | 725 | 553 | 27 | 37 | 0.7 | 3.9 | 50 | — |
| P2C | 723 | 515 | 23 | 31 | 0.9 | 19 | 401 | — |
| P2D | 720 | 526 | 29 | 40 | 0.9 | 17 | 502 | — |
| P2E | 728 | 560 | 30 | 58 | 1.8 | 101 | — | — |
| P2F | 834 | 662 | 28 | 63 | 0.8 | 4.1 | 37 | — |
| P2G | 789 | 613 | 30 | 62 | 0.9 | 7.6 | 29 | — |
| P2H | 818 | 606 | 29 | 60 | 1.1 | 10.4 | 50 | — |
| P2I | 788 | 614 | 31 | 60 | 2.2 | 14 | 182 | — |
| Phase III | | | | | | | | |
| P3A | 766 | 631 | 30 | 61 | 0.8 | 9.2 | 53 | — |
| P3B | 752 | 613 | 32 | 60 | 0.9 | 10.5 | 59 | — |
| P3C | 746 | 588 | 30 | 61 | 2.1 | 15.8 | 89 | — |
| P3D | 720 | 547 | 33 | 62 | 1.3 | 9.9 | 90 | — |
| P3E | 733 | 573 | 30 | 62 | 1.1 | 10.6 | 75 | — |
| P3F | 736 | 568 | 29 | 62 | 1 | 8.3 | 35 | — |
| P3A | 766 | 631 | 30 | 61 | 0.8 | 9.2 | 53 | — |

TABLE 2

| Phase IV | Composition (wt.) | | | | | Tensile Properties (MPa or %) | | | | Corrosion Rates (mpy) in Boiling HCl | | | |
|---|---|---|---|---|---|---|---|---|---|---|---|---|---|
| | | | | | | | | | | 1 | 2 | 3 | 4 |
| Alloy ID | Ni | Mo | O | Fe | Zr | YS | UTS | EL | RA | wt. % | wt. % | wt. % | wt. % |
| P4A2 | 0.2 | 3.8 | 0.18 | 0.15 | 0.75 | 616 | 757 | 32 | 65 | 1.0 | 17 | 87 | — |
| P4B2 | 0.4 | 3.8 | 0.18 | 0.15 | 0.75 | 633 | 763 | 30 | 62 | 0.8 | 9 | 52 | — |
| P4C2 | 0.1 | 4.2 | 0.18 | 0.15 | 1 | 629 | 766 | 30 | 67 | 1.1 | 17 | 94 | — |
| AN14394 | 0.44 | 3.43 | 0.16 | 0.18 | 0.74 | 629 | 766 | 30 | 67 | 0.7 | 11 | 67 | — |

TABLE 3

| Phase V | Composition (wt. %) | | | | | Tensile Properties (MPa or %) | | | | Corrosion Rates (mpy) in Boiling HCl | | | |
|---|---|---|---|---|---|---|---|---|---|---|---|---|---|
| | | | | | | | | | | 1 | 2 | 3 | 4 |
| Alloy ID | Ni | Mo | Fe | Zr | O | YS | UTS | EL | RA | wt. % | wt. % | wt. % | wt. % |
| P7A | 0.3 | 3.2 | 0.12 | 0.5 | 0.12 | 567 | 716 | 31 | 61 | 0.7 | 13 | 69 | — |
| P7B | 0.3 | 4.0 | 0.15 | 0.75 | 0.16 | 661 | 794 | 31 | 65 | 1.7 | 12 | 57 | — |
| P7C | 0.5 | 3.2 | 0.15 | 0.75 | 0.16 | 637 | 781 | 31 | 58 | 1.7 | 13 | 62 | — |
| P7D | 0.5 | 4.0 | 0.2 | 1.0 | 0.18 | 714 | 837 | 30 | 65 | 1.5 | 11 | 36 | — |
| P7E | 0.44 | 3.43 | 0.18 | 0.74 | 0.16 | 653 | 790 | 31 | 61 | 1.2 | 11 | 60 | — |

Referring to Table 1 above, the results of room temperature tensile tests and corrosion tests on initial samples of various alloy compositions manufactured as 200 g arc melted 'button' ingots in Phases I, II, and III are shown. Sample 'PC1' in Phase I of Table 1 (highlighted) is the nominal composition of Titanium Grade 12 (Ti-0.3Mo-0.8Ni). By comparing the results from PC1 with those for the other experimental compositions of Phases I & II, it should be understood that:

- decreasing the Ni content decreases the strength and corrosion resistance;
- increasing the Mo content increases the corrosion resistance, strength and also the ductility;
- addition of Zr significantly improves corrosion resistance [compare PC2 vs PG; P2A vs P2B; P2F vs P2H], but only gives a marginal increase in strength;
- increasing Fe increases the strength, with inconsistent effects on corrosion resistance;
- partially replacing the increase in Mo with Cr can give an adequate combination of corrosion resistance and strength. Addition of Cr was not pursued because it has a high vapor pressure which is inconvenient in EBCHM melting;
- it may be possible to replace Ni with Co, or to partly replace Mo with Co;
- addition of carbon increases the strength but is deleterious to the corrosion resistance; and/or
- addition of Silicon gives an increase of strength with small/inconclusive effects on the corrosion resistance. An alloy including Si may give satisfactory corrosion resistance if sufficient Ni and Mo are present.

Figure 6:
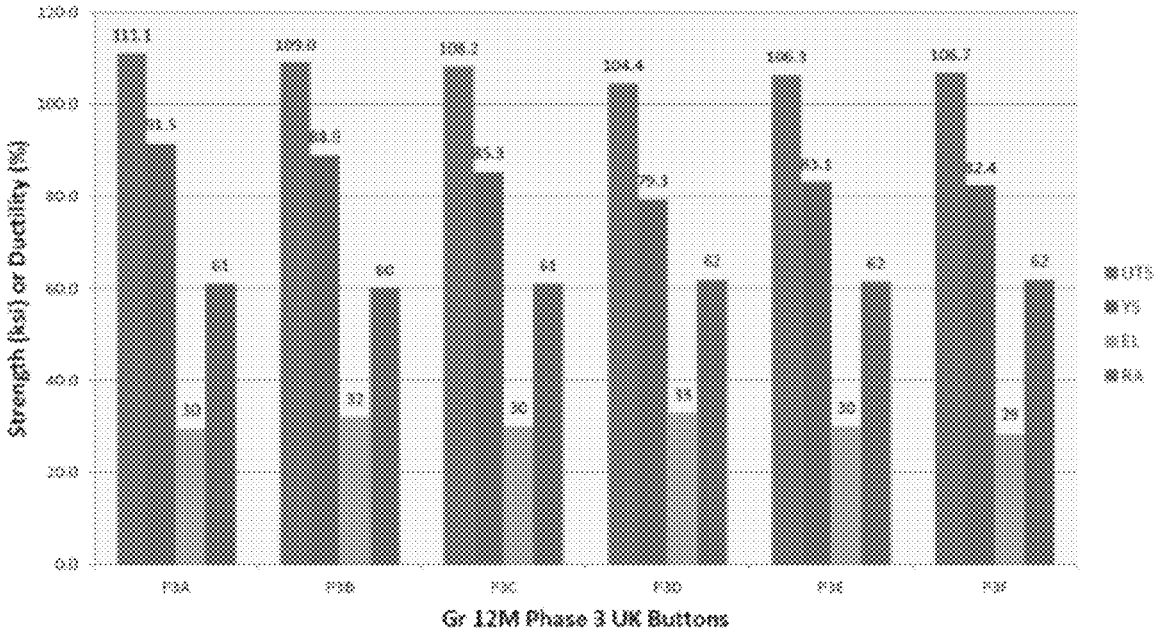
FIG. 6 is a bar chart of room temperature tensile test results from Phase 3 button samples according to the teachings of the present disclosure.
Figure 7:
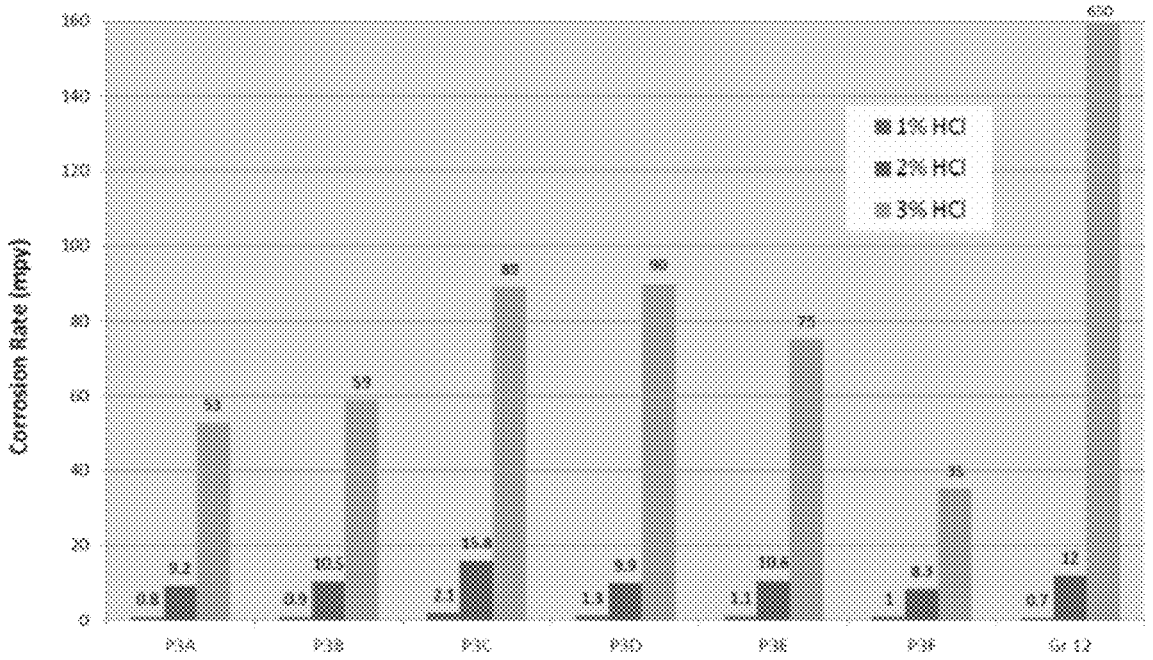
FIG. 7 is a bar chart of corrosion test results from Phase 3 button samples showing corrosion rate in boiling HCL.
Figure 8:
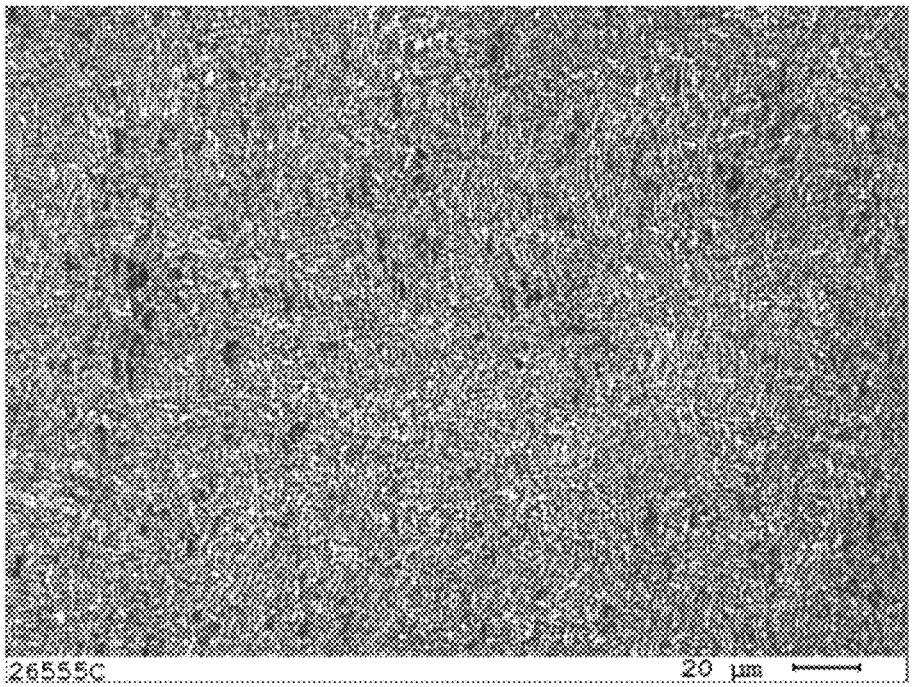
FIG. 8 is a photograph of the microstructure of a button sample of a titanium alloy according to the teachings of the present disclosure in a cold rolled and annealed condition.

Table 1 also shows experimental results from the Phase III series of 'buttons' as does FIGS. 6 and 7, and Table 2 shows results for an industrial scale EBCHM hollow ingot, Heat Number AN14394, along with an additional set of 'button' melts with varying contents of Ni, Mo, and Zr. Table 3 compares the extremes of the titanium alloy composition range according to the teachings of the present disclosure with P7E being the same nominal composition as the full scale heat AN14394. As shown in Tables 1-3 and FIG. 6, in some variations titanium alloys according to the teachings of the present disclosure have a 0.2% yield strength between 550 to 950 MPa. In at least one variation titanium alloys according to the teachings of the present disclosure have a yield strength between 550 to 750 MPa, a tensile strength between 700 to 900 MPa, an elongation to failure between 25 to 35%, and a reduction in area between 55 to 70%. In addition, and as shown in Tables 1-3 and FIG. 7, in some variations titanium alloys according to the teachings of the present disclosure have a corrosion rate of less than 2.5 mils per year (mpy) when exposed to 1 wt. % boiling hydrochloric acid per the ASTM G-31 test method. For example, in some variations the titanium alloys have a corrosion rate between 0.5 to 2.5 mpy when exposed to 1 wt. % boiling hydrochloric acid per the ASTM G-31 test method. In at least one variation the titanium alloys have a corrosion rate of less than 20.0 mils mpy when exposed to 2 wt. % boiling hydrochloric acid per the ASTM G-31 test method, for example a corrosion rate between 5.0 to 20.0 mpy when exposed to 2 wt. % boiling hydrochloric acid per the ASTM G-31 test method. Also, in some variations the titanium alloys have a corrosion rate of less than 100.0 mpy when exposed to 3 wt. % boiling hydrochloric acid per the ASTM G-31 test method, for example, between 30.0 to 100.0 mpy when exposed to 3 wt. % boiling hydrochloric acid per the ASTM G-31 test method.

Figure 9:
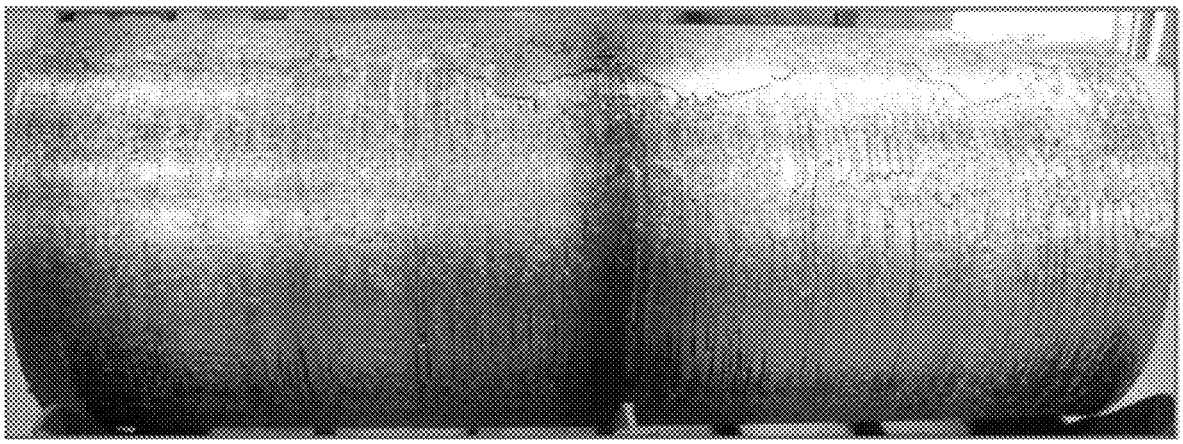
FIG. 9 is a photograph of the surface of a 30" outside diameter EBCHM single melt hollow ingot of a titanium alloy according to the teachings of the present disclosure.

The titanium alloy compositions according to the teachings of the present disclosure were essentially derived from or modifications to composition P2F in Phase II (Table 1). Note from FIG. 9 the improved ingot surface condition of an alloy according to the teachings of the present disclosure, compared to the ingot of Ti Grade 12 (Ti-0.3Mo-0.8Ni), shown in FIG. 4, occurring from the reduction in Ni content for the titanium alloys according to the teachings of the present disclosure. It should be understood that this improved surface condition leads directly to a significant increase in the product yield.

Referring to Tables 1-3 collectively, it should be understood that in some variations of the present disclosure elements such as aluminum (Al), vanadium (V), chromium (Cr), carbon (C), tin (Sn), silicon (Si) and niobium (Nb) are not intentionally added as alloying additions. Accordingly, in some variations Al, V, Cr, C, Sn, Si and Nb are impurities or incidental elements in the titanium alloys disclosed in the present disclosure and in such variations the maximum content of each impurity elements is less than or equal to 0.1 wt. % and a maximum total content of all impurity elements is less than 0.5 wt. %. Accordingly, in some variations the concentration of Al is less than or equal 0.1 wt. %, the concentration of V is less than or equal 0.1 wt. %, the concentration of Cr is less than or equal 0.1 wt. %, the concentration of C is less than or equal 0.1 wt. %, the concentration of Sn is less than or equal 0.1 wt. %, the concentration of Si is less than or equal 0.1 wt. % and/or the concentration of Nb is less than or equal 0.1 wt. %, and the total concentration of Al, V, Cr, C, Sn, Si and Nb is less than or equal to 0.5 wt. %.

Figure 10:
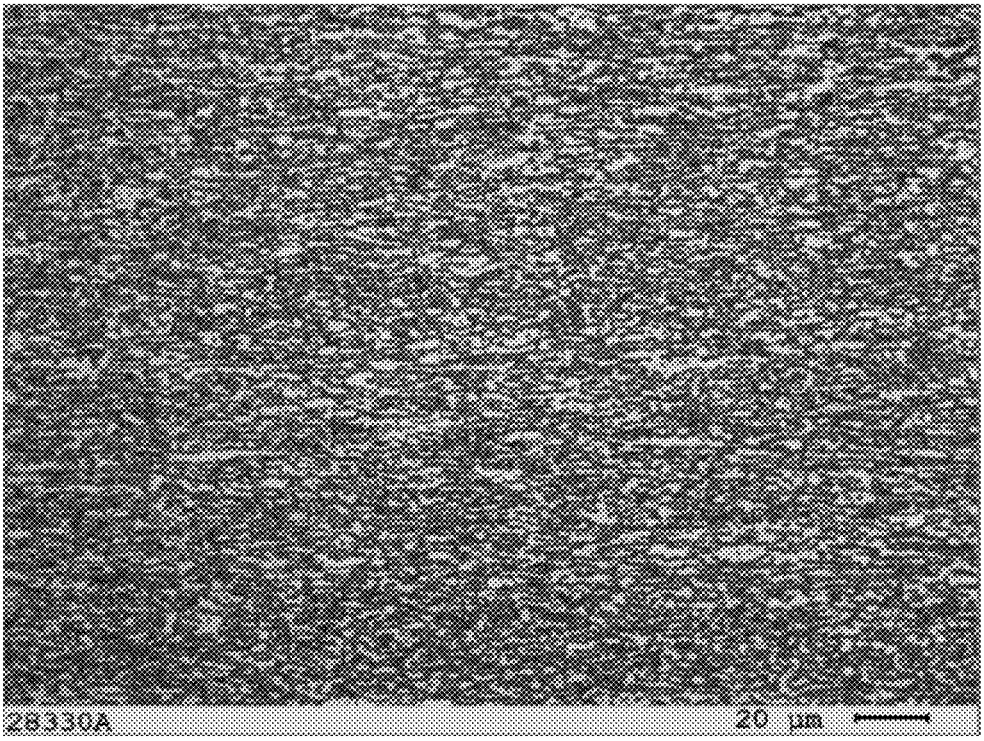
FIG. 10 is a photograph of microstructure of a cold rolled and annealed sheet sample of a titanium alloy according to the teachings of the present disclosure.

FIG. 8 shows a microstructures taken from a tensile test section manufactured from button sample P4B2 (Table 2) which had the same target composition as the Heat Number AN14394, and FIG. 10 shows a microstructure of sheet material rolled from Heat Number AN14394. Both samples were in the annealed heat treat condition and fine microstructure with uniform dispersion of alpha and beta phases is observed in both microstructures. In some variations of the present disclosure, with a volume fraction of the alpha phase is between 25 to 45% and a volume fraction of the beta phase is between 55% and 75%. In at least one variation, a volume fraction of the alpha phase is about 35% and a volume fraction of the beta phase is about 65%.

Figure 11:
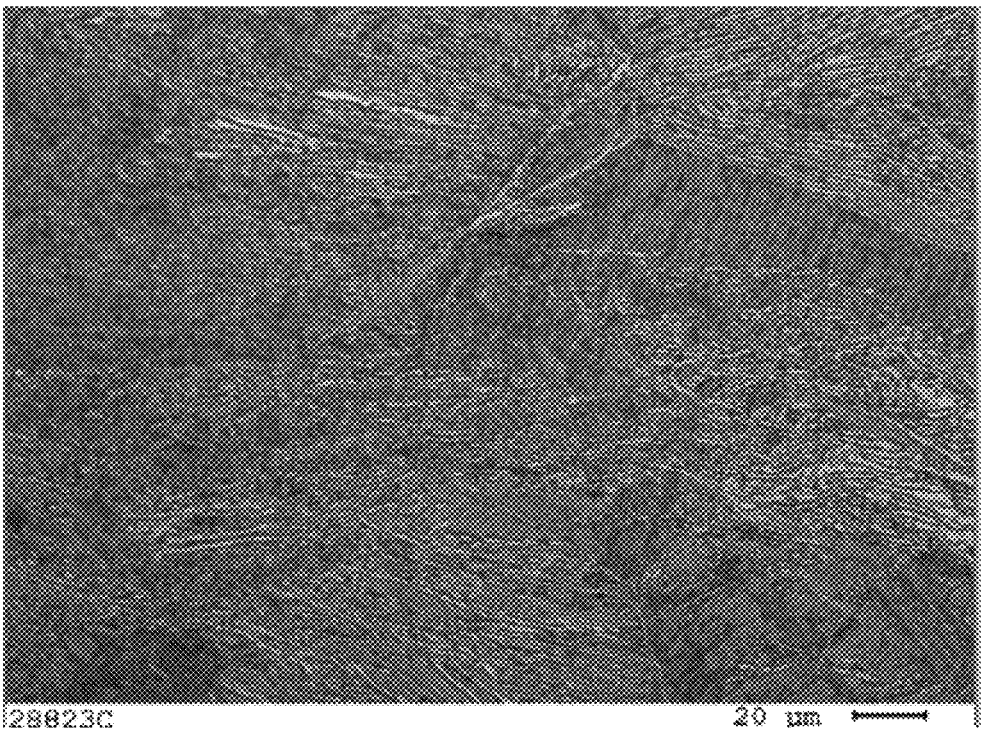
FIG. 11 is a photograph of microstructure of an extruded and annealed pipe of a titanium alloy according to the teachings of the present disclosure.
Figure 12:
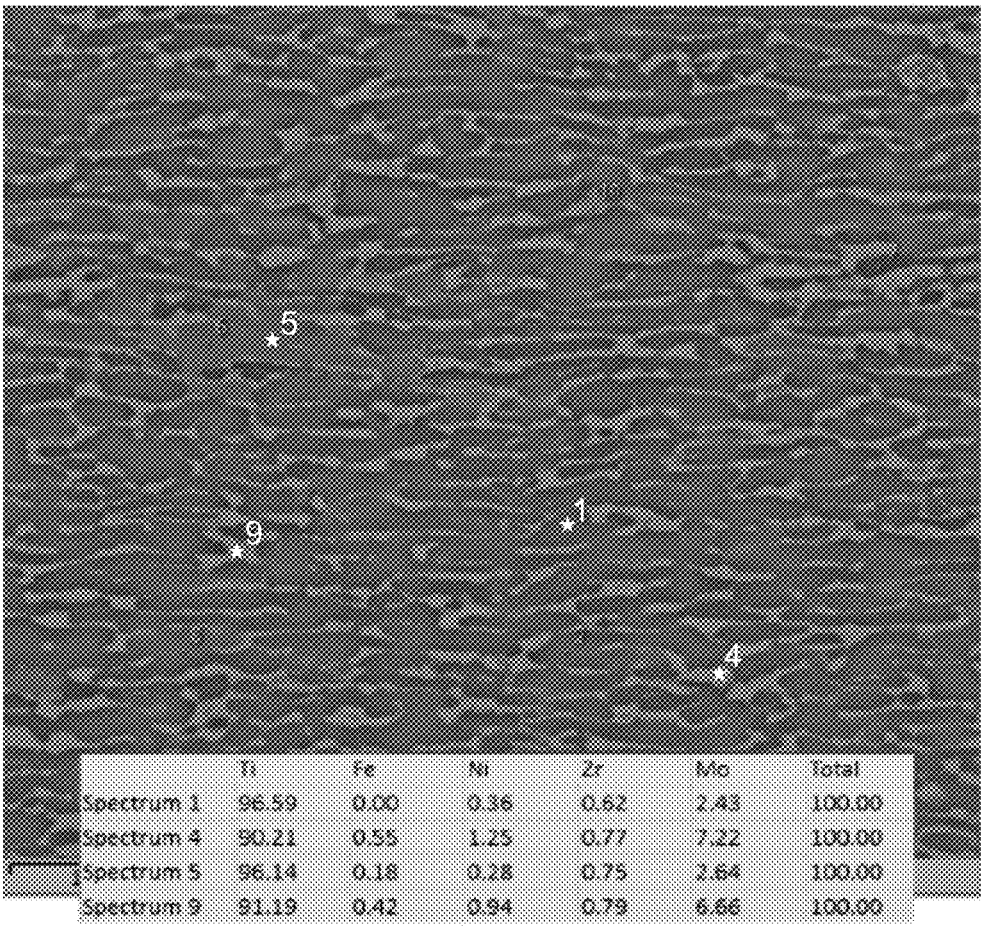
FIG. 12 is a scanning electron microscope (SEM) micrograph and phase compositions of a titanium alloy according to the teachings of the present disclosure.

Initial mechanical testing on the industrial scale EBCHM ingot Heat Number AN14394 included tensile tests for materials converted to cold rolled and annealed sheets by a small scale laboratory study as well as 9" diameter pipe material hot extruded and annealed in an industrial facility. The corresponding microstructures of these materials are shown in FIGS. 10 and 11. The hot extruded pipe exhibits a slightly coarser grain structure as would be expected due to a slower cooling rate, however, SEM examination of the microstructure as shown in FIG. 12 revealed the same two-phase structure of the alloy, with clear partitioning of the beta stabilizers Fe, Mo, and Ni to the beta phase (spectrums 4 and 9) as shown in the accompanying energy dispersive spectroscopy (EDS) composition analysis insert. Zirconium is consistent in both phases, which is in keeping with it being a neutral phase stabilizer. No evidence could be found for any compound phase such as $Ti_2Ni$. This is most likely due to two factors: (1) a decreased Ni content from Grade 12 titanium; and (2) a more prevalent volume fraction of beta phase to keep the Ni in solid solution. In addition, the mechanical properties of both materials (i.e., annealed sheet and annealed pipe) are quite consistent as shown in FIG. 15 despite the totally different processing routes involved.

Figure 13:
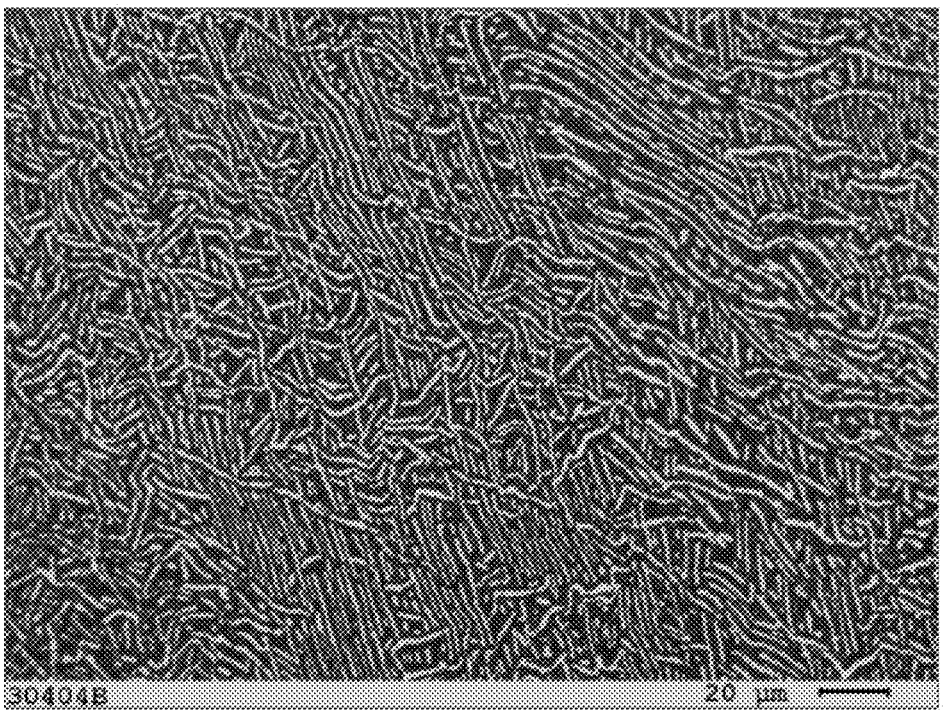
FIG. 13 is a photograph of an extruded and aged pipe microstructure of a titanium alloy according to the teachings of the present disclosure.

During a series of additional heat treatments on the extruded pipe it was found that the alloy responded in an unanticipated fashion to a solution treat and aging cycle. The aging treatment provided for an approximate 50% increase in yield strength, while maintaining an excellent reduction in area ductility. Neither titanium Grade 12 nor Ti-3Al-2.5V has such a heat treatment response. Even the most common heat treatable alpha/beta alloy, Ti-6Al-4V, only exhibits on the order of a 16-20% increase in yield strength when going from the annealed to the aged condition. This feature of the titanium alloys disclosed herein (i.e., the approximate 50% increase in yield strength, while maintaining an excellent reduction in area ductility) allows for processing at lower temperatures and improved yields over other alpha/beta alloys while in the low strength condition and then aged at final product stage. FIG. 13 shows the microstructure of the aged titanium alloy pipe material. Again, a two phase microstructure is exhibited, albeit a slightly larger volume fraction of beta phase and under SEM EDS analysis, similar phase compositions were seen as for the annealed condition (FIG. 14). The lower percent of Mo and Ni in the aged beta phase is due to the increased volume fraction of the phase as noted above. A summary of comparative tensile properties between the Heat Number AN14394 annealed sheet, annealed pipe, and aged pipe are shown in FIG. 15.

During testing on the titanium alloy extruded pipe it was noticed, as referenced above, that the alloy exhibited a very high reduction of area percent. This feature led to additional testing of the material in terms of dynamic tear toughness, ASTM test method E-604, which measures the amount of energy absorbed by the material during fracture. Compared to other alloys, the titanium alloys according to the teachings of the present disclosure exhibited the highest toughness results for any titanium alloy tested. As an example, the titanium alloy Ti-5111 (ASTM Grade 32; U.S. Pat. No. 5,358,686) was developed for the U.S. Navy for its dynamic tear resistance, which is much improved over other common alpha/beta alloys such as Ti-6Al-4V. However, the titanium alloys according to the teachings of the present disclosure display more than a 100% improvement in reduction of area over the Ti-5111 alloy, as shown in FIG. 16.

The corrosion resistance of the titanium alloys according to the teachings of the present disclosure was also confirmed on the full scale heat (AN14394) of material. General corrosion testing in boiling hydrochloric acid was performed according to the test method ASTM G-31 so as to rank the titanium alloys according to the teachings of the present disclosure against the common industrial grades as first shown in FIG. 1. A graph showing the relative position of the titanium alloys according to the teachings of the present disclosure compared to the other common titanium grades is shown in FIG. 17. The titanium alloys according to the teachings of the present disclosure exceed the corrosion resistance of Titanium Grade 12. In addition, samples of cold rolled sheet from Heat Number AN14394 were used to make U-Bend samples subjected to stress corrosion cracking tests per ASTM test method G-30 in a hypersaline geothermal brine at low pH and 500° F. for 30 days. No corrosion or cracking of the U-Bend samples was observed as shown in FIG. 18. Cold rolled sheet material from Heat Number AN14394 was also used to make localized corrosion test samples which were then subjected to crevice corrosion tests in hypersaline geothermal brine at low pH and 500° F. for 30 days. Again, no corrosion of the localized corrosion test samples was observed as shown in FIG. 19.

It should be understood from the teachings of the present disclosure that a Mo content of at least 3 wt. % provides the desired combination of strength, corrosion resistance, and high toughness. It should also be understood a maximum of 4.5 wt. % Mo (i.e., less than or equal to 4.5 wt. % Mo) in Ti—Mo alloys reduces the risk of occurrence of the deleterious omega phase. Hence, a range 3.0 to 4.5 wt. % Mo is desired. In some variations of the present disclosure, the Mo content is greater than or equal to 3.2 wt. %, for example, greater than or equal to 3.4 wt. %, 3.6 wt. %, 3.8 wt. %, 4.0 wt. %, or 4.2 wt. %. Also, in some variations of the present disclosure, the Mo content is less than or equal to 4.2 wt. %, for example, less than or equal to 4.0 wt. %, 3.8 wt. %, 3.6 wt. %, 3.4 wt. %, or 3.2 wt. %. It should be understood that the titanium alloy according to the present disclosure may have a range of Mo content greater than or equal to, and less than or equal to, any of the values noted above.

It should also be understood from the teachings of the present disclosure that a Ni content of at least 0.1 wt. % provides the desired strength and corrosion resistance and that a maximum of 1 wt. % Ni (i.e., less than or equal to 1.0 wt. % Ni) reduces the risk of ingot surface tearing, chemical segregation during solidification, diminished workability, and reduced ductility and toughness in the finished products. Hence, a range 0.1 to 1.0 wt. % Ni is desired. In some variations of the present disclosure, the Ni content is greater than or equal to 0.2 wt. %, for example, greater than or equal to 0.3 wt. %, 0.4 wt. %, 0.5 wt. %, 0.6 wt. %, 0.7 wt. % or 0.8 wt. %. Also, in some variations of the present disclosure, the Ni content is less than or equal to 0.9 wt. %, for example, less than or equal to 0.8 wt. %, 0.7 wt. %, 0.6 wt. %, 0.5 wt. %, 0.4 wt. %, or 0.3 wt. %. It should be understood that the titanium alloy according to the present disclosure may have a range of Ni content greater than or equal to, and less than or equal to, any of the values noted above.

It should also be understood from the teachings of the present disclosure that a Zr content of at least 0.1 wt. % improves the corrosion resistance of alloys disclosed herein, and enables the reduction of Ni content which facilitates CHM of the alloys. Zirconium is a comparatively high cost alloying element, so for cost effectiveness, the addition of Zr is limited to 1.5%. Hence, a range of 0.1 to 1.5 wt. % Zr is desired. In some variations of the present disclosure, the Zr content is greater than or equal to 0.2 wt. %, for example, greater than or equal to 0.4 wt. %, 0.6 wt. %, 0.8 wt. %, 1.0 wt. %, or 1.2 wt. %. Also, in some variations of the present disclosure, the Zr content is less than or equal to 1.4 wt. %, for example, less than or equal to 1.2 wt. %, 1.0 wt. %, 0.8 wt. %, 0.6 wt. %, or 0.4 wt. %. It should be understood that the titanium alloy according to the present disclosure may have a range of Zr content greater than or equal to, and less than or equal to, any of the values noted above.

It should also be understood from the teachings of the present disclosure that Fe in the range 0.05 to 0.3 wt. % provides a small, positive contribution to the strength of the alloys disclosed herein, and a small negative contribution to their corrosion resistance. Hence, a range 0.05 to 0.3 wt. % Fe is desired. In some variations of the present disclosure, the Fe content is greater than or equal to 0.07 wt. %, for example, greater than or equal to 0.09 wt. %, 0.12 wt. %, 0.15 wt. %, 0.18 wt. %, 0.21 wt. % or 0.24 wt. %. Also, in some variations of the present disclosure, the Fe content is less than or equal to 0.28 wt. %, for example, less than or equal to 0.25 wt. %, 0.22 wt. %, 0.19 wt. %, 0.16 wt. %, 0.13 wt. %, or 0.1 wt. %. It should be understood that the titanium alloy according to the present disclosure may have a range of Fe content greater than or equal to, and less than or equal to, any of the values noted above.

It should also be understood from the teachings of the present disclosure that the O content was held nominally constant at about 0.15 wt. %. and that O contributed significantly to the strength of the experimental alloys, while being low enough to reduce the risk of stress corrosion cracking. Hence, a range 0.05 to 0.2 wt. % O is desired. In some variations of the present disclosure, the O content is greater than or equal to 0.07 wt. %, for example, greater than or equal to 0.09 wt. %, 0.12 wt. %, or 0.15 wt. %. Also, in some variations of the present disclosure, the Fe content is less than or equal to 0.18 wt. %, for example, less than or equal to 0.15 wt. %, 0.12 wt. %, or 0.09 wt. %. It should be understood that the titanium alloy according to the present disclosure may have a range of Fe content greater than or equal to, and less than or equal to, any of the values noted above.

In some variations of the present disclosure, a titanium alloy has a Mo content in the range of 3.2 to 4.0 wt. %; a Ni content in the range of 0.3 to 0.5 wt. %; a Zr content in the range of 0.5 to 1.0 wt. %; an Fe content in the range of 0.1 to 0.25 wt. %; and an O content in the range of 0.12 to 0.18 wt. %. In some variations, a titanium alloy with this range of Mo, Ni, Zr, Fe, and O, has a maximum content of each impurity element disclosed above that is less than or equal to 0.1 wt. % and a maximum total content of all impurity elements is less than 0.5 wt. %. It should be understood that the range of elements noted above facilitates the alloy being melted into ingots using Electron Beam Cold Hearth Melting, or Plasma Arc Cold Hearth Melting, optionally followed by Vacuum Arc Melting. Also, a titanium alloy with this range of Mo, Ni, Zr, Fe, O, and impurity elements can have a 0.2% yield strength between 550 to 950 MPa, for example, a 0.2% yield strength between 550 to 750 MPa, a tensile strength between 700 to 900 MPa, an elongation to failure between 25 to 35%, a reduction in area between 55 to 70%. In at least one variation, a titanium alloy with this range of Mo, Ni, Zr, Fe, O, and impurity elements has a low corrosion rate when exposed to 1 wt. %, 2 wt. % or 3 wt. % boiling hydrochloric acid per the ASTM G-31 test method, for example, less than 2.5 mpy and/or between 0.5 to 2.5 mpy when exposed to 1 wt. % boiling hydrochloric acid per the ASTM G-31 test method, a corrosion rate of less than 20.0 mils mpy and/or between 5.0 and 20.0 mpy when exposed to 2 wt. % boiling hydrochloric acid per the ASTM G-31 test method, and/or less than 100.0 mpy and/or between 30.0 100.0 mpy when exposed to 3 wt. % boiling hydrochloric acid per the ASTM G-31 test method.

In some variations of the present disclosure focused on the production of plates; sheets; strip; and welded tubes and pipes, the Mo content is in the range 3.7 to 4.5 wt. %; the Ni content is in the range 0.1 to 0.3 wt. %; the Zr content is in the range 0.7 to 1.3 wt. %; the Fe content is in the range 0.1 to 0.25 wt. %; and the O is in the range 0.08 to 0.15 wt. %; and the alloy is melted into slab shaped ingots using Electron Beam Cold Hearth Melting. In some variations, a titanium alloy with this range of Mo, Ni, Zr, Fe, and O, has a maximum content of each impurity element disclosed above that is less than or equal to 0.1 wt. % and a maximum total content of all impurity elements is less than 0.5 wt. %. This composition is intended to enable improved slab ingot surface quality for rolling to flat products; while still providing for the enhanced strength and corrosion resistance in the flat products and pipes made from them. Also, a titanium alloy with this range of Mo, Ni, Zr, Fe, O, and impurity elements can have a 0.2% yield strength between 550 to 950 MPa, for example, a 0.2% yield strength between 550 to 750 MPa, a tensile strength between 700 to 900 MPa, an elongation to failure between 25 to 35%, a reduction in area between 55 to 70%. In at least one variation, a titanium alloy with this range of Mo, Ni, Zr, Fe, O, and impurity elements has a low corrosion rate when exposed to 1 wt. %, 2 wt. % or 3 wt. % boiling hydrochloric acid per the ASTM G-31 test method, for example, less than 2.5 mpy and/or between 0.5 to 2.5 mpy when exposed to 1 wt. % boiling hydrochloric acid per the ASTM G-31 test method, a corrosion rate of less than 20.0 mils mpy and/or between 5.0 and 20.0 mpy when exposed to 2 wt. % boiling hydrochloric acid per the ASTM G-31 test method, and/or less than 100.0 mpy and/or between 30.0 100.0 mpy when exposed to 3 wt. % boiling hydrochloric acid per the ASTM G-31 test method.

In other variations of the present disclosure, a titanium alloy is intended to be double melted to ingot by the EB-VAR method, and the Mo content is in the range 3.2 to 4.0 wt. %; the Ni content is in the range 0.6 to 1.0 wt. %; the Zr content is in the range 0.1 to 0.3 wt. %; the Fe content is in the range 0.1 to 0.25 wt. %; and the O is in the range 0.12 to 0.18 wt. %. In some variations, a titanium alloy with this range of Mo, Ni, Zr, Fe, and O, has a maximum content of each impurity element disclosed above that is less than or equal to 0.1 wt. % and a maximum total content of all impurity elements is less than 0.5 wt. %. Also, a titanium alloy with this range of Mo, Ni, Zr, Fe, O, and impurity elements can have a 0.2% yield strength between 550 to 950 MPa, for example, a 0.2% yield strength between 550 to 750 MPa, a tensile strength between 700 to 900 MPa, an elongation to failure between 25 to 35%, a reduction in area between 55 to 70%. In at least one variation, a titanium alloy with this range of Mo, Ni, Zr, Fe, O, and impurity elements has a low corrosion rate when exposed to 1 wt. %, 2 wt. % or 3 wt. % boiling hydrochloric acid per the ASTM G-31 test method, for example, less than 2.5 mpy and/or between 0.5 to 2.5 mpy when exposed to 1 wt. % boiling hydrochloric acid per the ASTM G-31 test method, a corrosion rate of less than 20.0 mils mpy and/or between 5.0 and 20.0 mpy when exposed to 2 wt. % boiling hydrochloric acid per the ASTM G-31 test method, and/or less than 100.0 mpy and/or between 30.0 100.0 mpy when exposed to 3 wt. % boiling hydrochloric acid per the ASTM G-31 test method.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The description of the disclosure is merely exemplary in nature and, thus, variations that do not depart from the substance of the disclosure are intended to be within the scope of the disclosure. Such variations are not to be regarded as a departure from the spirit and scope of the disclosure.

As used herein, the phrase at least one of A, B, and C should be construed to mean a logical (A OR B OR C), using a non-exclusive logical OR, and should not be construed to mean "at least one of A, at least one of B, and at least one of C.

What is claimed is:

1. A titanium alloy consisting of:
molybdenum between 3.0 to 4.5 wt. %;
nickel between 0.1 to 1.0 wt. %;
zirconium between 0.1 to 1.5 wt. %;
iron between 0.05 to 0.3 wt. %;
oxygen between 0.05 to 0.25 wt. %; and
a balance of titanium and unavoidable impurities.

2. The titanium alloy of claim 1 further comprising a microstructure with a volume fraction of an alpha phase between 25 to 45% and a volume fraction of a beta phase between 55% and 75%.

3. The titanium alloy of claim 2, wherein the volume fraction of the alpha phase is about 35% and the volume fraction of the beta phase is about 65%.

4. The titanium alloy of claim 1, wherein final hot forging, rolling, or extrusion or other final hot working operation is performed at a temperature below a beta transus of the titanium alloy.

5. The titanium alloy of claim 1 further comprising a yield strength between 550 to 930 MPa.

6. The titanium alloy of claim 1 further comprising a yield strength between 550 to 750 MPa, a tensile strength between 700 to 900 MPa, an elongation to failure between 25 to 35%, and a reduction in area between 55 to 70%.

7. The titanium alloy of claim 1 further comprising a corrosion rate of less than 2.5 mils per year (mpy) when exposed to 1 wt. % boiling hydrochloric acid per the ASTM G-31 test method.

8. The titanium alloy of claim 1 further comprising a corrosion rate between 0.5 to 2.5 mils per year (mpy) when exposed to 1 wt. % boiling hydrochloric acid per the ASTM G-31 test method.

9. The titanium alloy of claim 1 further comprising a corrosion rate of less than 20.0 mils per year (mpy) when exposed to 2 wt. % boiling hydrochloric acid per the ASTM G-31 test method.

10. The titanium alloy of claim 1 further comprising a corrosion rate between 5.0 to 20.0 mils per year (mpy) when exposed to 2 wt. % boiling hydrochloric acid per the ASTM G-31 test method.

11. The titanium alloy of claim 1 further comprising a corrosion rate of less than 100.0 mils per year (mpy) when exposed to 3 wt. % boiling hydrochloric acid per the ASTM G-31 test method.

12. The titanium alloy of claim 1 further comprising a corrosion rate between 30.0 to 100.0 mils per year (mpy) when exposed to 3 wt. % boiling hydrochloric acid per the ASTM G-31 test method.

13. The titanium alloy of claim 1, wherein nickel is between 0.2 to 1.0 wt.

14. The titanium alloy of claim 1, wherein
the molybdenum is between 3.6 to 4.0 wt. %;
the nickel is between 0.3 to 0.5 wt. %;
the zirconium is between 0.6 to 0.8 wt. %;
the iron is between 0.12 to 0.16 wt. %; and
the oxygen is between 0.15 to 0.18 wt. %.

15. A titanium alloy comprising:
molybdenum between 3.0 to 4.5 wt. %;
nickel between 0.2 to 1.0 wt. %;
zirconium between 0.1 to 1.5 wt. %;
iron between 0.05 to 0.3 wt. %;
oxygen between 0.05 to 0.25 wt. %; and
a balance of titanium and unavoidable impurities.

16. The titanium alloy of claim 15, wherein:
the molybdenum is between 3.2 to 4.0 wt. %;
the nickel is between 0.3 to 0.5 wt. %;
the zirconium is between 0.5 to 1.0 wt. %;
the iron is between 0.1 to 0.25 wt. %; and
the oxygen is between 0.12 to 0.18 wt. %.

17. The titanium alloy of claim 15, further comprising a microstructure with a volume fraction of an alpha phase between 25 to 45% and a volume fraction of a beta phase between 55% and 75%.

18. The titanium alloy of claim 15, further comprising a yield strength between 550 to 750 MPa, a tensile strength between 700 to 900 MPa, an elongation to failure between 25 to 35%, and a reduction in area between 55 to 70%.

19. The titanium alloy of claim 15, further comprising a corrosion rate of less than 2.5 mils per year (mpy) when exposed to 1 wt. % boiling hydrochloric acid per the ASTM G-31 test method.

20. A titanium alloy comprising:
molybdenum between 3.6 to 4.0 wt. %;
nickel between 0.3 to 0.5 wt. %;
zirconium between 0.6 to 0.8 wt. %;
iron between 0.12 to 0.16 wt. %;
oxygen between 0.15 to 0.18 wt. %; and
a balance of titanium and unavoidable impurities.

* * * * *